US008758064B2

(12) United States Patent
Nagase et al.

(10) Patent No.: US 8,758,064 B2
(45) Date of Patent: Jun. 24, 2014

(54) MULTIPLE CONTACT CONNECTOR

(75) Inventors: Teruki Nagase, Kanagawa (JP); Hidehiro Matsushita, Kanagawa (JP); Koji Chikano, Tokyo (JP); Masanori Yagi, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 38 days.

(21) Appl. No.: 13/549,589

(22) Filed: Jul. 16, 2012

(65) Prior Publication Data

US 2013/0178114 A1 Jul. 11, 2013

(30) Foreign Application Priority Data

Jul. 14, 2011 (JP) ..... 2011-155952

(51) Int. Cl.
*H01R 24/00* (2011.01)

(52) U.S. Cl.
USPC ..... 439/676

(58) Field of Classification Search
USPC ..... 439/676, 660, 74, 78, 108, 862, 856
See application file for complete search history.

(56) References Cited

U.S. PATENT DOCUMENTS

| | | | | |
|---|---|---|---|---|
| 6,482,050 | B1 * | 11/2002 | Lemke et al. | 439/856 |
| 6,926,538 | B2 * | 8/2005 | Ma | 439/74 |
| 7,097,465 | B1 * | 8/2006 | Korsunsky et al. | 439/74 |
| 7,137,832 | B2 * | 11/2006 | Mongold et al. | 439/108 |
| 7,309,239 | B2 * | 12/2007 | Shuey et al. | 439/74 |
| 7,722,413 | B2 * | 5/2010 | Tonosaki | 439/751 |
| 8,206,182 | B2 * | 6/2012 | Kuo et al. | 439/676 |
| 8,398,443 | B2 * | 3/2013 | Groll et al. | 439/862 |
| 8,454,387 | B2 * | 6/2013 | Peng et al. | 439/607.35 |
| D686,575 | S * | 7/2013 | Sato | D13/147 |
| 8,523,616 | B2 * | 9/2013 | Pan | 439/660 |
| 2004/0185691 | A1 * | 9/2004 | Ma | 439/74 |
| 2008/0032524 | A1 * | 2/2008 | Lemke et al. | 439/78 |
| 2012/0225583 | A1 * | 9/2012 | Kamarauskas et al. | 439/607.01 |

FOREIGN PATENT DOCUMENTS

| | | |
|---|---|---|
| JP | 2007-141586 | 6/2007 |

* cited by examiner

*Primary Examiner* — Alexander Gilman
(74) *Attorney, Agent, or Firm* — Timothy M. Morella

(57) ABSTRACT

A multiple contact connector comprises a plurality of terminal pieces arranged linearly in the lengthwise direction, and an insulating provided with a plurality of dividing walls extending between the terminal pieces for supporting the terminal pieces and for insulating between adjacent terminal pieces, having the insulating pieces inserted into terminal supporting spaces between the separating walls.

18 Claims, 10 Drawing Sheets

MULTIPLE CONTACT CONNECTOR

REFERENCE TO RELATED APPLICATIONS

The Present Disclosure claims priority to prior-filed Japanese Patent Application No. 2011-155952, entitled "Multiple Contact Connector," filed on 14 Jul. 2011 with the Japanese Patent Office. The content of the aforementioned Patent Application is incorporated in its entirety herein.

BACKGROUND OF THE PRESENT DISCLOSURE

The Present Disclosure relates, generally, to a multiple contact connector, and, more particularly, to a multiple contact connector that is small and that is able to suppress a reduction in the impedance value at the time of high-speed transmission.

When transmitting data via signal lines, the value of the impedance at the connecting portion of a connector, that connects between a signal line and a device has an effect on the transmission speed. In particular, if the impedance of the connecting portion on the signal receiving side does not match that of the device side when performing high-speed transmissions, then the high-frequency component of the transmitted signal will be reflected, potentially rendering increases in transmission speed impossible.

On the other hand, for a variety of reasons, such as increasing the quantity of data transmitted simultaneously, there are cases where multiple signal lines are connected in parallel. In such cases, a connector of a type wherein a large number of signal lines are connected all at once is used. In such a connector, a large number of contacts electrically independent of each other are arrayed in a housing fabricated from an insulating material, and connected together with a mate housing, to connect a large number of contacts simultaneously. In the Present Disclosure below, a connector of this type shall be termed a "multiple contact connector."

In Japanese Patent Application No. 2005-332231, the content of which is incorporated herein in its entirety, there is a description of a multiple contact connector having a ground contact and a low-speed transmission signal contact that are pressed into a housing. In a press fitting portion of the contact, a part is provided that protrudes symmetrically on both sides of a metal terminal, where the contact is secured within the housing through the protruding parts pressing against the inner surface of a contact receptacle portion of the housing (see FIGS. 15-6).

SUMMARY OF THE PRESENT DISCLOSURE

As described above, in order to increase the speed of signal transmission, it is necessary to match the impedance value for the contact with that of the signal side. On the other hand, device miniaturization necessitates miniaturization of the contacts themselves, where simply making the multiple contact connector smaller would reduce the distances between the contacts, which would reduce the impedance value, at the time of high-speed transmission, through forming capacitances between the contacts, which would interfere with the matching of impedances with the device.

The Present Disclosure was created in contemplation of this situation, and the problem solved thereby is that of providing a multiple contact connector that is small and that is able to suppress a reduction in the impedance value at the time of high-speed transmission. In order to solve this problem, the multiple contact connector according to the Present Disclosure comprises a plurality of terminal pieces arranged linearly in the lengthwise direction, and an insulating provided with a plurality of dividing walls extending between the terminal pieces for supporting the terminal pieces and insulating between adjacent terminal pieces, having the insulating pieces inserted into terminal supporting spaces between the separating walls. Of the terminal pieces adjacent in the lengthwise direction, a securing protrusion, for securing the terminal piece that presses against the dividing wall, is provided on an end face of the terminal piece that faces another terminal piece, and, on the end face of the other terminal piece that faces the first terminal piece, a recessed portion is provided in a location corresponding to the securing protrusion of the first terminal piece.

The multiple contact connector according to the Present Disclosure enables the provision of a multiple contact connector that is small and able to suppress a reduction in the impedance value at the time of high-speed transmission.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features.

While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
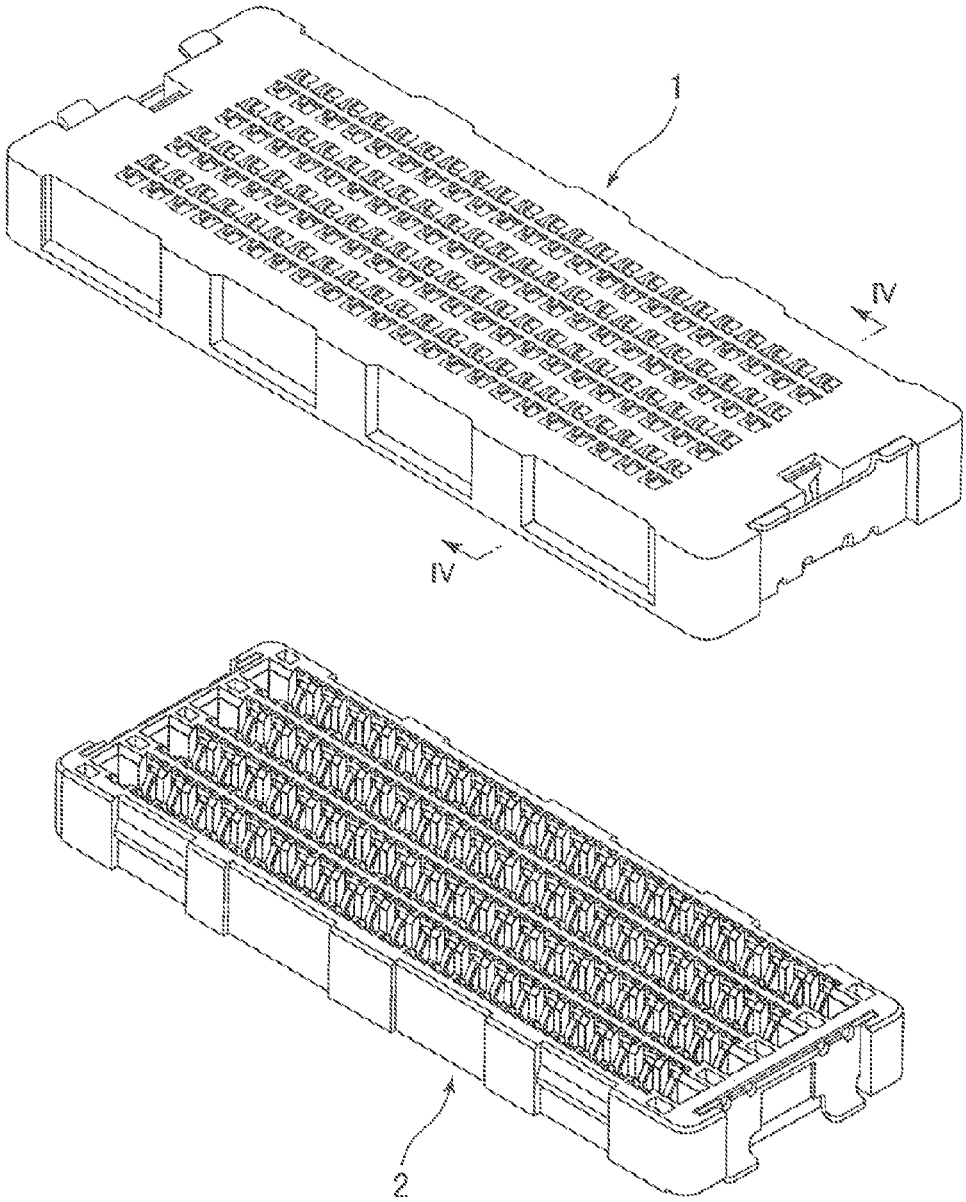
FIG. 1 is a perspective diagram illustrating a male connector and a female connector that structure a multiple contact connector according to an embodiment of the Present Disclosure.

FIG. 1 is a perspective diagram illustrating a male connector 1 and a female connector 2 that structure a multiple contact connector according to an embodiment of the Present Disclosure. In FIG. 1, the male connector 1 is mounted on an FPC (Flexible Printed Circuit, not shown), and can be seen to the front of the mounting face that is connected electrically, and the connecting face of the female connector 2 that connection with the male connector 1 can be seen. The female connector 2 is mounted on a circuit board, not shown.

Note that while, in the present embodiment, the male connector 1 is defined as a plug that connects to the cable side of an FPC, or the like, and the female connector 2 is defined as a receptacle that connects to the device side, such as a circuit board, there is no limitation thereto, but rather the plug/receptacle relationship may instead be reversed. Conversely, both the male connector 1 and the female connector 2 may be connected to a cable, or both may be connected to circuit boards. Moreover, while in the multiple contact connector illustrated in FIG. 1 there are eight rows wherein 22 contacts are arranged linearly in each row, to have a total of 176 contacts, there is no limitation thereto, but rather the number of contacts and the number of rows may be set depending on the purpose. In fact, there need only be at least a plurality of contacts arranged linearly in a row, and the number of such rows need only be at least one. Finally, note that the multiple contact connector illustrated in FIG. 1 is used in transmission of data to and from a CPU (Central Processing Unit). While the communication speed is approximately 15 Gpps, there are no limitations to this application or this communication speed.

Figure 2:
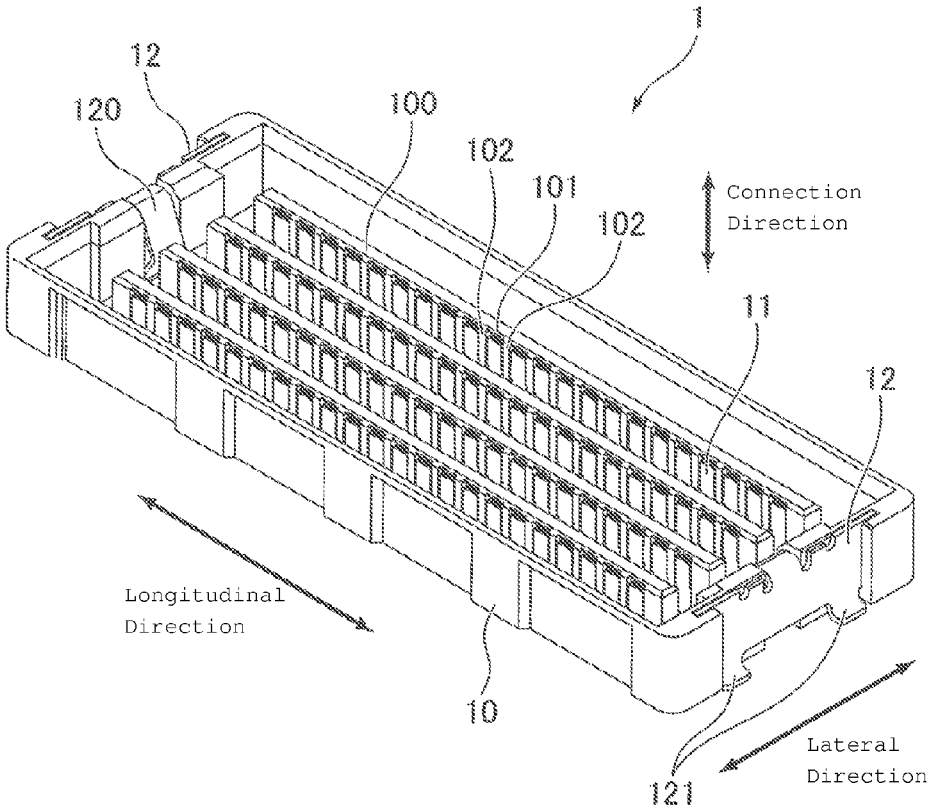
FIG. 2 is a perspective diagram viewing the male connector of FIG. 1 from the connecting face side.

FIG. 2 is a perspective diagram when the male connector 1 is viewed from the connecting face side. The male connector 1 is structured from a male-side housing 10, which is an insulating housing, a plurality of terminal pieces 11 that are attached to the male-side housing so as to not be in electrical contact with each other (in the Figure, these are all indicated with only a single code), and a nail 12, that is an attachment reinforcing hardware that is attached to the outer peripheral portion of the male-side housing 10.

The male-side housing 10 is roughly a box shape, having an opening on the connecting face side, and, in the present embodiment, is fabricated through the molding a liquid crystal polymer resin. Note that the material of the male-side housing 10 may be any material insofar as it is electrically insulating, but the reason why a liquid crystal polymer resin is used in the present embodiment is that it has high fluidity at the time of molding and is thus well-suited to the fabrication of the fine structures of the male-side housing 10.

The terminal piece 11 is a roughly flat plate-shape metal piece that has been punched from a metal plate and subjected to a slight bending process through a press process. However, there is no particular limitation on the shape of the terminal piece 11, but rather it may be any shape insofar as it functions as a terminal. Note that the "terminal piece" of the Present Disclosure is used to indicate a single unit of an electrically conductive member that structures a contact for making an electrical connection.

The nail 12 is a metal member that reinforces the attachment, provided on the peripheral edge of the male-side housing 10. In the nail 12, an elastic connecting portion 120 is formed on a location on the inside of the male-side housing 10, and when the male connector 1 is connected to the female connector 2, it interlocks with a nail 22 of the female connector 2, described below, to secure together the male connector 1 and the female connector 2. Note that at this time the nail 12 and the nail 22, of the female connector 2, are connected electrically. Additionally, a mounting connecting portion 121 is provided protruding on the end portion of the mounting face side of the male-side housing 10 of the nail 12, and is soldered so as to produce a shield potential when the male connector 1 is mounted on a cable, such as an FPC or the like.

Note that, in the below, the direction in which the terminal pieces 11 are arranged linearly shall be termed the "lengthwise direction," and the direction, of the connecting face, that is perpendicular to the lengthwise direction shall be termed the "short direction," where the direction in which the multiple contact connector is connected shall be termed the "connecting direction." These directions are illustrated in FIG. 2.

The terminal pieces 11 are provided in the male-side housing 10, arranged linearly, extending in the lengthwise direction, to both wall faces of the supporting walls 100 that protrude in the connecting direction. Terminal piece supporting spaces 101, box-shaped indentations that extend in the connecting direction in both wall faces of the supporting walls 100, are formed with the same count as the terminal pieces 11. Moreover, each individual terminal piece 11 is secured within a terminal piece supporting space 101 through insertion, in this case, from the connecting face side into the terminal piece supporting space 101. In the Present Disclosure, the direction in which a terminal piece 11 is inserted into the terminal piece supporting space 101 shall be termed the "inserting direction." Note that in the present embodiment the inserting direction is the same as the connecting direction, there is not necessarily any limitation thereto, but rather, depending on the form of the male-side housing 10, the inserting direction and the connecting direction may be different directions. For example, the inserting direction may be the short direction.

Adjacent terminal supporting spaces 101 are separated lengthwise by separating walls 102 that protrude in the short direction. Because of this, adjacent terminal pieces 11 are insulated by the separating walls 102. Moreover, the end faces of the terminal pieces 11 in the lengthwise direction contact the separating walls 102, and the terminal pieces 11 are supported thereby so as to not fall out of the male-side housing 10. That is, the separating walls 102 extend in the inserting direction between the terminal pieces 11, and not only support the terminal pieces 11, but also insulate between adjacent terminal pieces 11. Moreover, the terminal piece supporting spaces 101 are spaces between separating walls 102 that are adjacent in the lengthwise direction.

Figure 3:
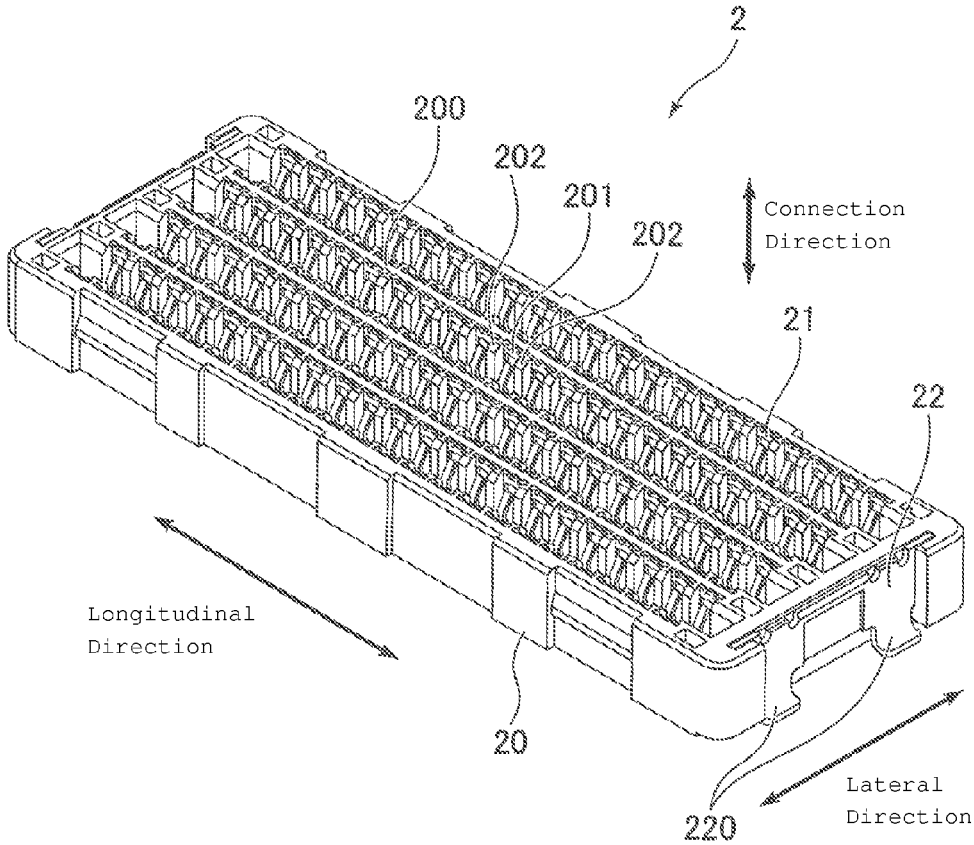
FIG. 3 is a perspective diagram viewing the female connector of FIG. 1 from the connecting face side.

FIG. 3 is a perspective diagram when the female connector 2 is viewed from the connecting face side. The female connector 2 is structured from a female-side housing 20, which is an insulating housing, a plurality of terminal pieces 21 that are attached to the female-side housing so as to not be in electrical contact with each other (where, in the figure, these are all indicated with only a single code), and a nail 22, that is an attachment reinforcing hardware that is attached to the outer peripheral portion of the female-side housing 20. The female-side housing 20, as with the male-side housing 10, described above, is also roughly a box shape having an opening on the connecting face side, and is fabricated from a liquid crystal polymer resin. It is also similar in that the material for the female-side housing 20 may also be an insulating material.

While the shape of the terminal piece 21 is different from that of the terminal piece 11 used in the male connector 1, described above, it is the same in the point that it is metal punched out from a metal plate and then subjected to a bending process, and in the point that it be of any shape that functions as a terminal. However, as described below, the shapes of the end faces of the metal piece 21 on the lengthwise sides are important in order to control the impedance value of the female connector 2, which, in this case, is to control a drop in the impedance value.

The nail 22 is a metal member as an attachment reinforcement that is provided on the peripheral edge of the female-side housing 20, and, as illustrated in FIG. 2, is contacted by an elastic connecting portion 120 of the nail 12 of the male connector 1, so that the two not only interlock but are connected electrically. A mounting connecting portion 220 is provided so as to protrude on the end portion of the nail 22 on the mounting face side of the female-side housing 20, and, at the time of mounting of the female connector 2 onto the circuit board, is actually soldered to become a shield potential.

Note that the lengthwise direction, short direction, connecting direction, and inserting direction are all the same as for the case of the male connector 1, described above.

The terminal pieces 21 are also provided in the female-side housing 20, arranged linearly in rows that extend in the lengthwise direction to both side walls of the supporting walls 200 that extend in the connecting direction. The difference from the supporting walls 100 (shown in FIG. 2) is that the supporting walls 200 either interlock with the outer peripheral wall of the female-side housing 20 or a portion of the outer peripheral wall serves as the supporting walls 200. Terminal piece supporting spaces 201, which are box-shaped indentations that extend in the connecting direction, are formed in both wall sides of the supporting walls 200 (the wall sides on the inside if the supporting walls 200 are the outer peripheral walls), with the same count as the number of terminal pieces 21, and each individual terminal piece 21 is inserted into, and secured in, a terminal piece supporting space 201. While, as illustrated, the inserting direction may be the same as the connecting direction, it may be a different direction instead.

In the female connector 2 as well, adjacent terminal piece supporting spaces 201 are separated by separating walls 202 that protrude in the short direction, and are spaces between the separating walls 202 that are adjacent in the lengthwise direction. Moreover, the separating walls 202 extend in the inserting direction between terminal pieces 21, both supporting the terminal pieces 21 and insulating between adjacent terminal pieces 21.

Figure 4:
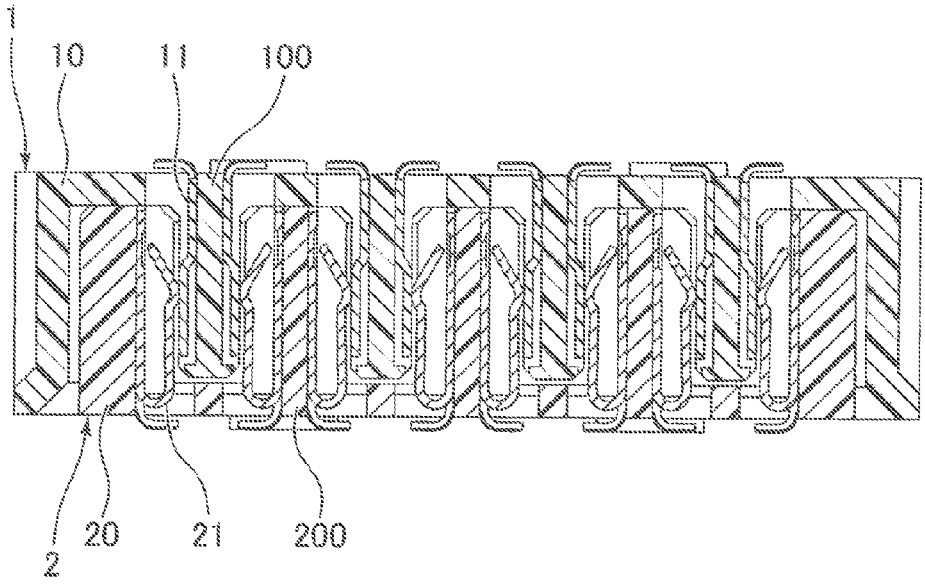
FIG. 4 is a cross-sectional diagram along Section Iv-Iv in the state wherein the multiple contact connector of FIG. 1 is connected.

FIG. 4 is a cross-sectional diagram along the Section Iv-Iv in the state wherein the multiple contact connector illustrated in FIG. 1 is connected. This figure shows a state wherein terminal pieces 11, provided at both wall faces of the supporting walls 100 of the male connector 1, are inserted into the space of a terminal piece 21 provided at a wall face of the supporting wall 200 of the female connector 2 or at a wall face on the inside of the outer peripheral wall, to make connections through contacts between terminal pieces 11 and terminal pieces 21. The terminal piece 11 and the terminal piece 21 form a state wherein they press against each other through elasticity when the multiple contact connector is connected, to thereby prevent a contact failure between the terminal piece 11 and the terminal piece 21.

Figure 5:
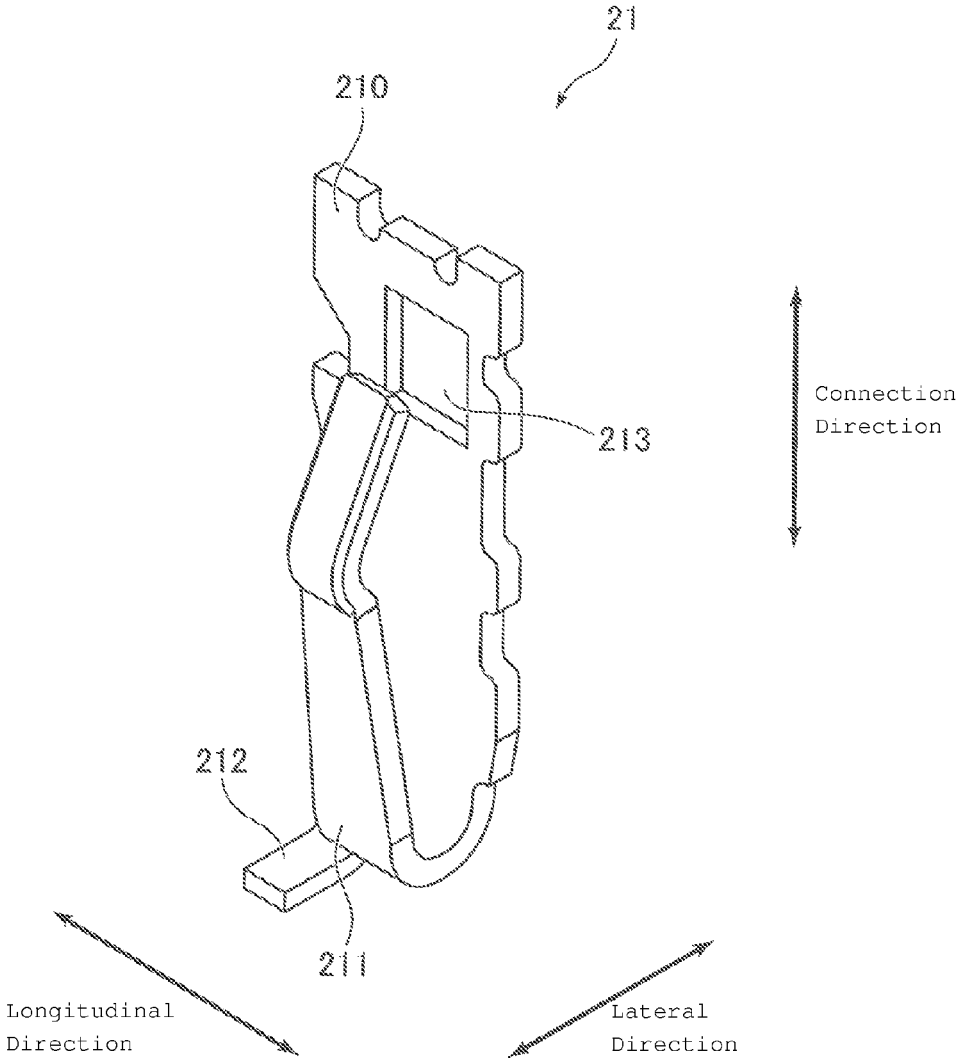
FIG. 5 is a perspective diagram illustrating a terminal piece in the female connector of FIG. 1.

FIG. 5 is a perspective diagram illustrating a terminal piece 21 of the female connector 2. The terminal piece 21, as described above, is formed through performing a bending process after punching from a metal plate. The terminal piece 21 is formed with an elastic connecting portion 211 and a circuit board connecting portion 212 extending from the end portion on the bottom side in the connecting direction (and therefore, the inserting direction) that is one and of an essentially plate-shaped main body 210 that is inserted into, and secured in, the aforementioned terminal piece supporting space 201 (see FIG. 3). The elastic connecting portion 211 is bent back, to the main body 210 side, in the form of a U, from one end of the main body 210, to have spring elasticity, enabling elastic deformation in the short direction. As illustrated in FIG. 4, this causes the terminal piece 21 and the terminal piece 11 to be pushed against each other, enabling a reliable electrical connection. That is, the elastic connecting portion 211 is the contact in the multiple contact connector in the present embodiment. Moreover, the circuit board contacting portion 212 is the part that serves as the terminal for connecting, through soldering or the like, the connecting piece 21 to the circuit board on which the female connector 2 is mounted. While, in the present embodiment, the circuit board mounting portion 212 protrudes from the main body 210 bent at a 90° angle, the shape of the circuit board connecting portion 212 may be of a variety of shapes depending on the form of embodiment of the female connector 2, and alternatively it may be shaped as a lead line that extends in a straight line, for example, from the main body 210.

Indentations 213 are provided at locations corresponding to the tip ends of the elastic connecting portions 211 of the main bodies 210. This is to prevent plastic deformation of the elastic connecting portion 211 itself by the tip ends striking the main body 210 at the time of the elastic deformation of the elastic connecting portions 211. The indentations 213 can be formed easily through providing the indentations 213 in advance, through forging or the like, prior to performing the punching process on the metal plate when manufacturing the terminal pieces 21. Conversely, instead of the indentations 213, holes may be provided in the main bodies 210. In this case, the holes may be provided in advance in the metal plate, or the holes may be formed simultaneously when performing the punch process on the metal plate.

Figure 6:
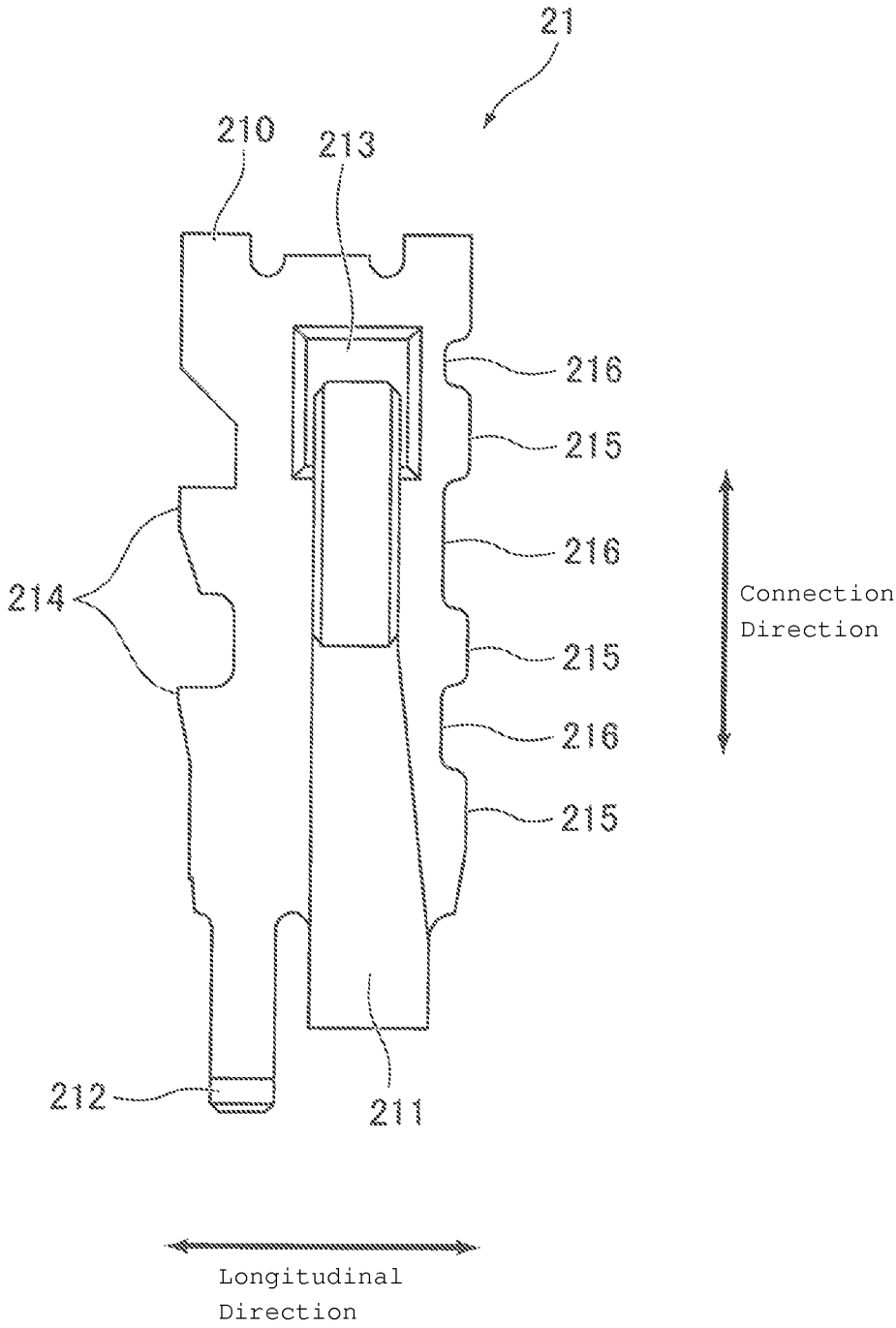
FIG. 6 is a plan view diagram of the terminal piece of FIG. 5 when viewed from the short direction.

FIG. 6 is a plan view diagram viewing a terminal piece 21 in the short direction. The end face of the main body 210 in the lengthwise direction is provided with raised and recessed portions. In the lengthwise-direction end face of the terminal piece 21, on one face, a raised portion that is provided on the side face on the left side in the figure is a securing protrusion 214, and when the terminal piece 21 is inserted into the terminal piece supporting space 201, it has the function of contacting the separating wall 202 and pushing strongly against it so as to secure the terminal piece 21 (see FIG. 3). On the other hand, on the other face on the opposite side, the side face on the right side in the figure serves as a flat reference face 215, and has the role of being in facial contact with the separating wall 202, to establish the location of the terminal piece 21 in the lengthwise direction. Doing so establishes the location of the terminal piece 21 in the lengthwise direction with precision, causes the spacing between adjacent terminal pieces 21 to be uniform. This reduces the variability in the impedance in the female connector 2. Additionally, a recessed portion 216 is provided as appropriate in the end face that serves as the reference face 215. In the present embodiment, the location of the recessed portion 216 is at a location that corresponds to the securing protrusion 214 in relation to the connecting direction.

Figure 7:
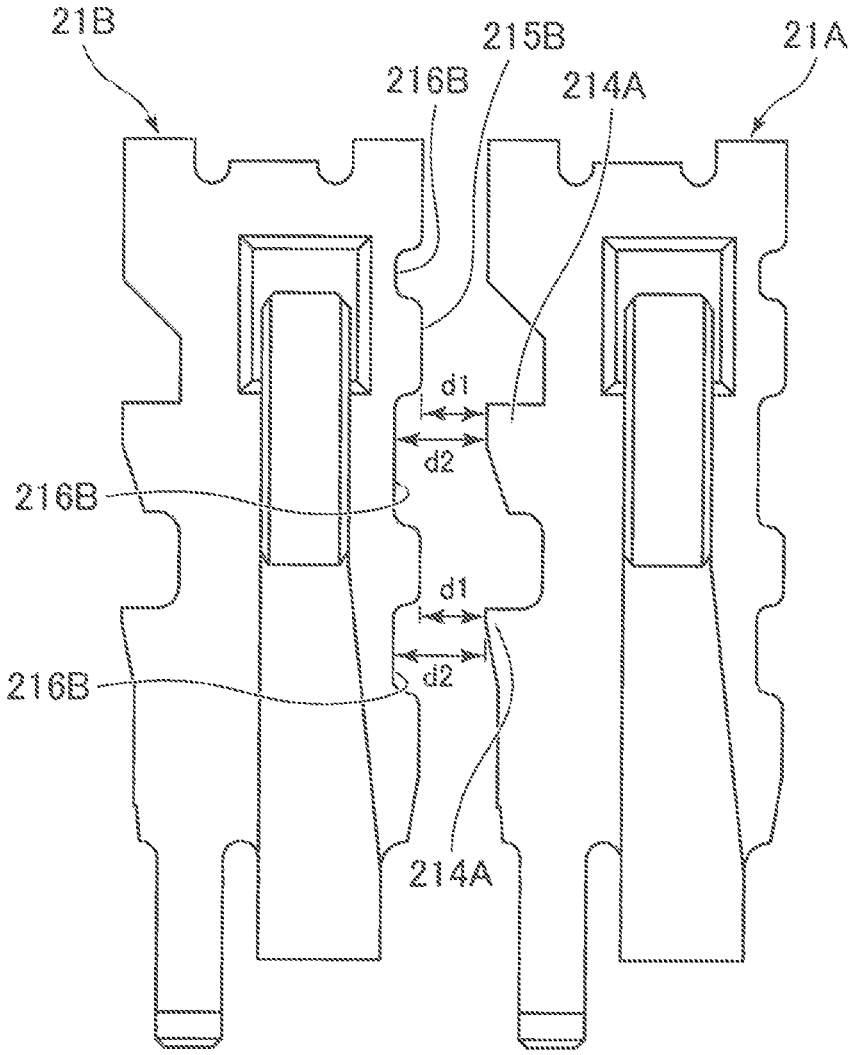
FIG. 7 is a diagram illustrating the positional relationship between two adjacent terminal pieces among the plurality of terminal pieces.

The function of the recessed portion 216 will be explained in reference to FIG. 7, which shows the positional relationship between two adjacent terminal pieces 21A, 21B among the plurality of terminal pieces 21. When the female connector 2 is miniaturized, reducing the pitch between contacts, the distance between the terminal pieces 21A, 21B is also reduced. In this case, the capacitance produced between the terminal pieces 21A, 21B is increased, and the impedance produced as a result (the capacitive reactance) becomes non-negligible. The capacitance formed between the terminal pieces 21A, 21B is proportional to the surface area with which the terminal pieces 21A, 21B face each other, and inversely proportional to the distance across which they face. That is, the nearer the terminal pieces 21A, 21B, and the larger the surface areas of the parts that are in proximity, the greater the capacitance produced between the terminal pieces 21A, 21B. Moreover, as is well-known, the capacitive reactance is inversely proportional to the capacitance. Consequently, the greater the capacitance produced between the terminal pieces 21A, 21B, the less the impedance of the female connector 2. This means that the greater the surface area of the parts that face each other in proximity between the terminal pieces 21A, 21B, the smaller the impedance of the female connector 2.

Here, the nearest location in the terminal piece 21A to the terminal piece 21B is the location wherein the securing protrusion 214A is provided. Thus, a recessed portion 216B is provided at a location that corresponds to the securing protrusion 214A on the face of the terminal piece 21B adjacent to the terminal piece 21A, facing the terminal piece 21A. Doing this causes the distance d1 between the securing protrusion 214A and the reference face 215B, in the case wherein the recessed portion 216B is not provided, to increase to a distance d2 (where d2>d1) between the securing protrusion 214A and the recessed portion 216B, decreasing the capacitance between the terminal pieces 21A, 21B, and so increases the impedance in the female connector 2.

As is clear from the explanation above, the recessed portion 216B need not necessarily be provided at all locations corresponding to the securing protrusions 214B. Even if recessed portions 216B are provided only in a portion of the locations corresponding to the securing protrusions 214A, the capacitance will still be reduced, and thus a range may be established for the provision of the recessed portions 216B depending on the value for the impedance required for the female connector 2. Of course, recessed portions 216B may be provided in parts other than the locations corresponding to the securing protrusions 214A. Actually, in the example illustrated in FIG. 7, of the recessed portions 216B shown at three locations, the one furthest to the top is not provided in a location that corresponds to a securing protrusion 214A.

Note that in the embodiment shown and illustrated in FIG. 6, a securing protrusion 214 is provided on one end face, in the lengthwise direction, of the terminal piece 21, and a recessed portion 216 is provided at a location corresponding to the securing protrusion 214 on the other end face. In this structure, the recessed portion 216 of a terminal piece 21 will be disposed at the location corresponding to the adjacent securing protrusion 214 through merely arranging in a line, in the lengthwise direction, terminal pieces 21 having identical shapes. However, another structure may be used insofar as the recessed portion 216 of the terminal piece 21 is disposed at a location corresponding to the adjacent securing protrusion 214.

Figure 8:
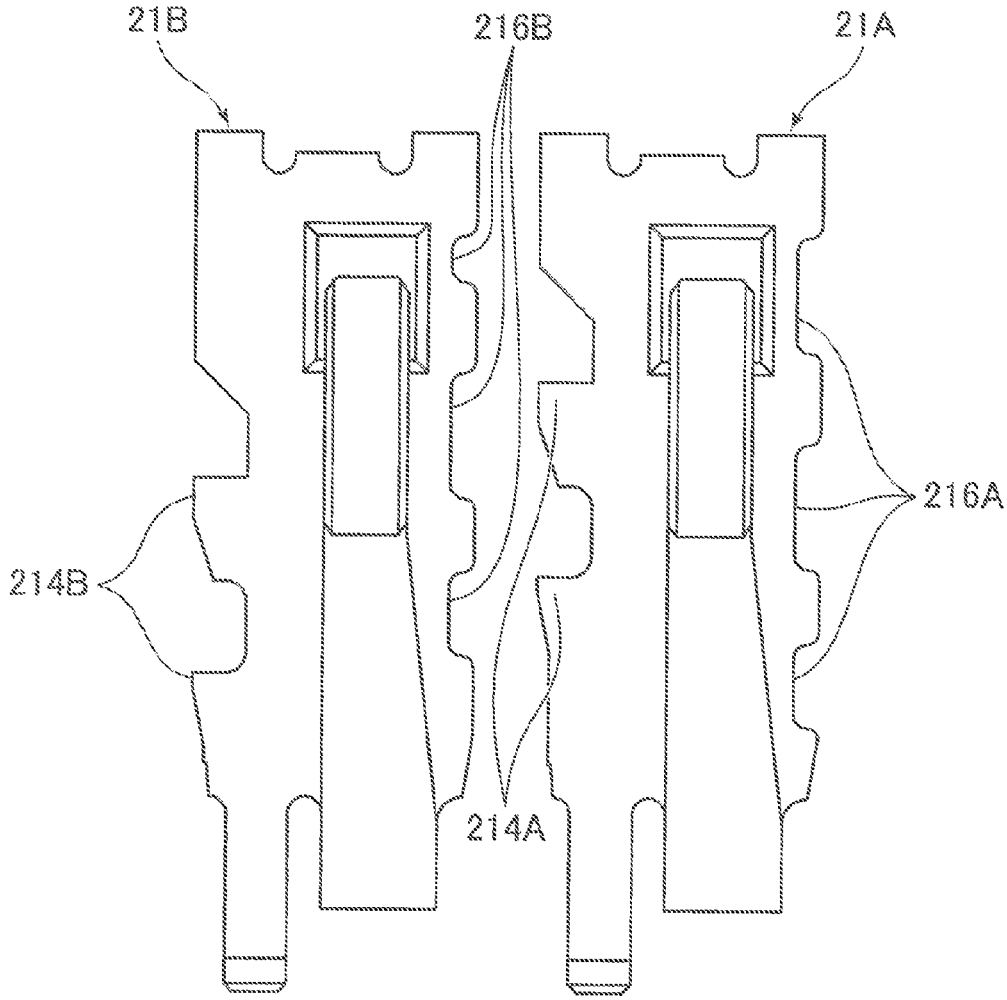
FIG. 8 is a plan view diagram illustrating an alternate example of adjacent terminal pieces.

FIG. 8 is a plan view diagram showing an alternate example of adjacent terminal pieces 21A, 21B. In this alternate example, the shapes of the terminal pieces 21A, 21B are different. Moreover, looking at the terminal piece 21A alone, the recessed portion 216A is not formed in a location corresponding to the securing protrusion 214A. The same is true when the terminal piece 21B is viewed alone. Also in this alternate example, the terminal pieces 21A, 21B are intended to be arranged alternatingly in the lengthwise direction. Moreover, at this time the recessed portion 216B of the terminal piece 21B will be located at a location corresponding to the securing protrusion 214A of the terminal piece 21A. The same is true for the recessed portion 216A of the terminal piece 21A and the securing protrusion 214B of the terminal piece 21B. In this way, even preparing different types of terminal pieces 21A, 21B so as to have different shapes and have the locations, in the inserting direction, of the securing protrusions 214A, 214B of the terminal pieces 21A, 21B that are disposed adjacently in the lengthwise direction be different can result in the recessed portion 216B (or recessed portion 216A) of the terminal piece being located at a location corresponding to the adjacent securing protrusion 214A (or securing protrusion 214B)

Note that while in this alternate example two types of terminal pieces, 21A and 21B, were prepared, three or more types may be prepared instead.

Figure 9:
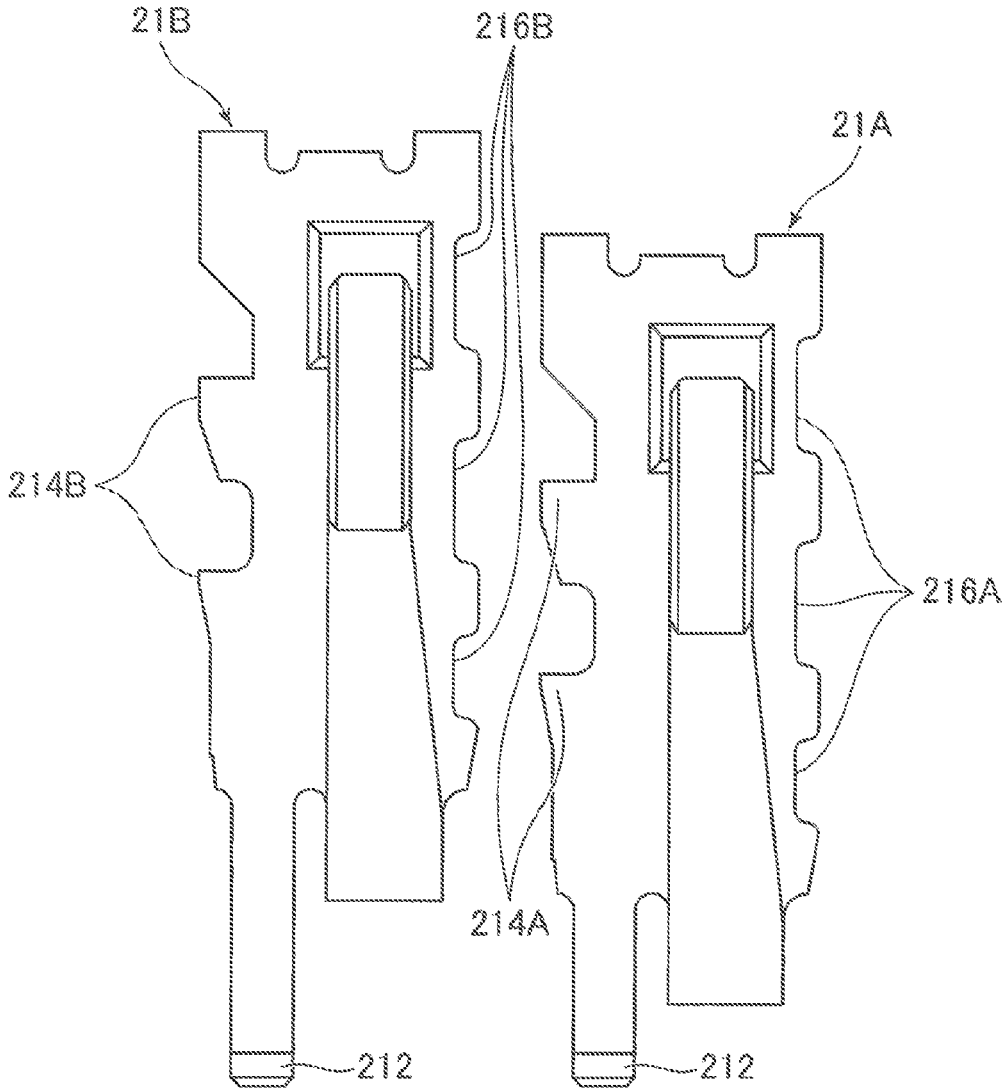
FIG. 9 is a plan view diagram illustrating another alternate example of adjacent terminal pieces.

FIG. 9 is a plan view diagram illustrating another alternate example of adjacent terminal pieces 21A, 21B. In this alternate example, the shapes of the terminal pieces 21A, 21B are identical to each other except for the circuit board connecting portion 212, but the recessed portions 216A, 216B of the terminal pieces 21A, 21B are not formed at locations corresponding, respectively, to the securing protrusions 214A, 214B. Moreover, the locations in the inserting direction of terminal pieces 21A, 21B that are disposed adjacently in the lengthwise direction are disposed so as to be at mutually differing insertion depths relative to the female-side housing 20 (shown in FIG. 3). That is, in this alternate example, the terminal pieces 21A, 21B, having different insertion depths, are lined up alternatingly in the lengthwise direction.

Even that enables the disposal of the recessed portions 216B (or recessed portions 216A) of the terminal pieces to be located corresponding to the adjacent securing protrusions 214A (or securing protrusions 214B). Note that in this case the insertion depths of the terminal pieces 21A, 21B are different, and thus if the shapes of the terminal pieces 21A, 21B are exactly identical, then the locations in the connecting direction of the circuit board connecting portion 212 would be different, making mounting of the female connector 2 onto the circuit board difficult. Because of this, in the alternate example here the length of the circuit board connecting portions 212 in the connecting direction are different for the terminal pieces 21A and the terminal pieces 21B. However, as described above, in the case of the circuit board connecting portion 212 being a lead line shape or another shape, the shapes of the terminal pieces 21A, 21B may be identical if, for example, the connecting direction and the inserting direction are different.

Figure 10:
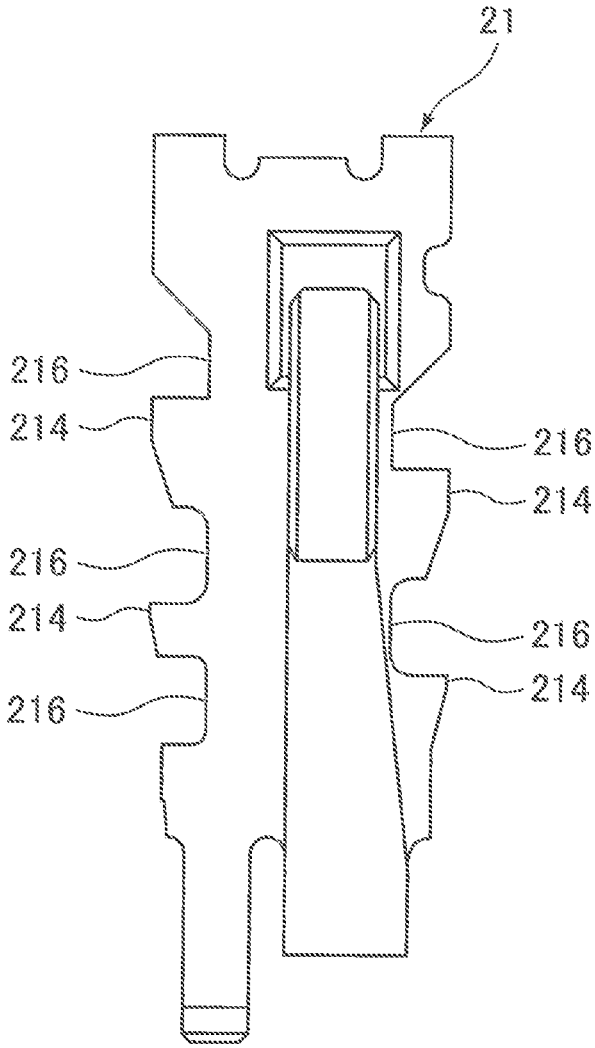
FIG. 10 is a plan view diagram illustrating an alternate example of a terminal piece.

Note that while in the examples described herein, the end face on the opposite side of the end face wherein the securing protrusion 214 is provided is defined as a reference face 215, the reference face 215 is not absolutely necessary. For example, as illustrated in FIG. 10, the securing protrusions 214 may be provided on both end faces in the lengthwise direction. In this case, the part where the securing protrusions 214 are held is the recessed portion 216. In this way, even though the accuracy of the lengthwise positioning of the terminal pieces 21 would suffer somewhat, it is possible to secure the terminal pieces 21 strongly in the female-side housing 20.

Note that while in the examples described herein, the explanation of the positional relationships between the securing protrusions 214 and the recessed portions 216 were in the terminal pieces 21 used in the female connector 2, the same structure may be used in the terminal pieces 11 used in the male connector 1. The use of the structure set forth above in both the male connector 1 and the female connector 2 can produce a multiple contact connector with an overall high impedance value. Also, note that in one aspect of the Present Disclosure explained above, the securing protrusion is provided at one lengthwise-direction end face of the terminal piece, and the recessed portion is provided at a location corresponding to the securing protrusion on the other lengthwise-direction end face of the terminal piece. Doing so enables a multiple contact connector with a high impedance value using terminal pieces with identical shapes.

Moreover, in another aspect of the Present Disclosure, the terminal pieces arranged adjacently in the lengthwise direction have mutually differing locations, in the terminal piece inserting direction, for the securing protrusions. This can also produce a multiple contact connector with a high impedance value. Further, in another aspect of the Present Disclosure, the terminal pieces arranged adjacently in the lengthwise direction have mutually differing locations, in the direction of insertion of the terminal pieces, relative to the housing. This can also produce a multiple contact connector with a high impedance value. Likewise, in another aspect of the Present Disclosure, the end face wherein the recessed portion is provided is a reference face for establishing the location of the terminal piece by contacting the separating wall. This determines the location of the terminal piece accurately, making it possible to suppress variation in the impedance values. Finally, in another aspect of the Present Disclosure, the terminal piece has a plate-shaped main body, and an elastic connecting portion having elasticity that extends bent toward the main body side from one end of the main body, and a recessed portion or a hole is provided at a location corresponding to the tip end of the elastic connecting portion of the main body. This makes it possible to prevent contact with the main body and deformation thereof at the time of elastic deformation.

While a preferred embodiment of the Present Disclosure is shown and described, it is envisioned that those skilled in the art may devise various modifications without departing from the spirit and scope of the foregoing Description and the appended Claims.

What is claimed is:

1. A multiple contact connector, the multiple contact connector comprising:

a plurality of terminal pieces, each terminal piece being arranged linearly in the lengthwise direction, each terminal piece including a securing protrusion and a recessed portion; and a supporting space, the supporting space including a plurality of separating walls extending between the terminal pieces for supporting the terminal pieces and insulating adjacent terminal pieces, the supporting spaces being inserted into terminal supporting spaces between the separating walls;

wherein:

of the terminal pieces adjacent in the lengthwise direction, a securing protrusion, for securing one terminal piece that presses against the dividing wall, is provided on an end face of the one terminal piece that faces the other terminal piece; and on an end face of the other terminal piece that faces the one terminal piece, a recessed portion is provided in a location corresponding to the securing protrusion of the one terminal piece.

2. The multiple contact connector of claim 1, wherein the end face of the other terminal piece is a reference face for determining the location of the one terminal piece through contacting a dividing wall.

3. The multiple contact connector of claim 1, wherein each terminal piece has a plate-shaped main body and an elastic connecting portion, the elastic connecting portion extending from one end of the main body and being bent toward the main body.

4. The multiple contact connector of claim 3, wherein the recessed portion is located at a tip end of the elastic connecting portion.

5. The multiple contact connector of claim 1, wherein the end face of a one terminal piece includes the securing protrusion, and the end face of the other terminal piece includes the recessed portion, the recessed portion being disposed at a location corresponding to the securing protrusion.

6. The multiple contact connector of claim 5, wherein the end face of the other terminal piece is a reference face for determining the location of the one terminal piece through contacting a dividing wall.

7. The multiple contact connector of claim 5, wherein each terminal piece has a plate-shaped main body and an elastic connecting portion, the elastic connecting portion extending from one end of the main body and being bent toward the main body.

8. The multiple contact connector of claim 7, wherein the recessed portion is located at a tip end of the elastic connecting portion.

9. The multiple contact connector of claim 1, wherein the terminal pieces disposed adjacently in the lengthwise direction have mutually differing locations in the inserting direction thereof.

10. The multiple contact connector of claim 9, wherein the end face of the other terminal piece is a reference face for determining the location of the one terminal piece through contacting a dividing wall.

11. The multiple contact connector of claim 9, wherein each terminal piece has a plate-shaped main body and an elastic connecting portion, the elastic connecting portion extending from one end of the main body and being bent toward the main body.

12. The multiple contact connector of claim 9, wherein the recessed portion is located at a tip end of the elastic connecting portion.

13. The multiple contact connector of claim 1, wherein, relative to the housing, the locations of the terminal pieces, in the inserting direction thereof, disposed adjacently in the lengthwise direction are mutually different.

14. The multiple contact connector of claim 13, wherein each terminal piece has a plate-shaped main body and an elastic connecting portion, the elastic connecting portion extending from one end of the main body and being bent toward the main body.

15. The multiple contact connector of claim 14, wherein the recessed portion is located at a tip end of the elastic connecting portion.

16. The multiple contact connector of claim 13, wherein the end face of the other terminal piece is a reference face for determining the location of the one terminal piece through contacting a dividing wall.

17. The multiple contact connector of claim 16, wherein each terminal piece has a plate-shaped main body and an elastic connecting portion, the elastic connecting portion extending from one end of the main body and being bent toward the main body.

18. The multiple contact connector of claim 17, wherein the recessed portion is located at a tip end of the elastic connecting portion.

* * * * *